United States Patent [19]

Pleasants et al.

[11] Patent Number: 5,007,479

[45] Date of Patent: Apr. 16, 1991

[54] HYDRAULIC UP-DOWN WELL JAR AND METHOD OF OPERATING SAME

[75] Inventors: Charles W. Pleasants, Carrollton; Keith W. Scott, Farmersville, both of Tex.

[73] Assignee: Otis Engineering Corporation, Dallas, Tex.

[21] Appl. No.: 423,483

[22] Filed: Oct. 11, 1989

Related U.S. Application Data

[63] Continuation of Ser. No. 269,996, Nov. 14, 1988, abandoned.

[51] Int. Cl.[5] ..... E21B 31/113

[52] U.S. Cl. ..... 166/178; 166/301; 175/297

[58] Field of Search ..... 175/296, 297; 166/178, 166/301

[56] References Cited

U.S. PATENT DOCUMENTS

| | | | |
|---|---|---|---|
| Re. 28,768 | 4/1976 | Mason | 175/297 |
| 1,927,836 | 9/1933 | Kightlinger | 175/297 |
| 2,499,695 | 3/1950 | Storm | 175/297 |
| 2,828,822 | 4/1958 | Greer | 166/178 |
| 2,851,110 | 9/1958 | Greer | 166/178 |
| 3,051,239 | 8/1962 | Dollison | 166/125 |
| 3,051,243 | 8/1962 | Grimmer et al. | 166/224 |
| 3,088,533 | 5/1963 | Sutliff | 175/297 |
| 3,208,531 | 9/1965 | Tamplen | 166/125 |
| 3,393,002 | 7/1968 | Woolley . | |
| 3,405,773 | 10/1968 | Sutliff et al. | 175/297 |
| 3,944,273 | 3/1976 | Ahlstone | 294/86.1 |
| 3,946,819 | 3/1976 | Hipp | 175/296 |
| 3,949,821 | 4/1976 | Raugust | 175/297 |
| 4,007,798 | 2/1977 | Gazda | 175/297 |
| 4,093,294 | 6/1978 | Taylor | 294/86.25 |
| 4,161,224 | 7/1979 | Hostrup | 175/297 |
| 4,179,002 | 12/1979 | Young | 175/297 |
| 4,181,186 | 1/1980 | Blanton | 175/297 |
| 4,185,865 | 1/1980 | Taylor | 294/86.3 |
| 4,186,807 | 2/1980 | Sutliff et al. | 175/302 |
| 4,346,770 | 8/1982 | Beck | 175/297 |
| 4,396,061 | 8/1983 | Tamplen et al. | 166/217 |
| 4,436,150 | 3/1984 | Barker | 166/131 |
| 4,515,220 | 5/1985 | Sizer et al. | 166/384 |
| 4,558,895 | 12/1985 | Tamplen | 294/86.18 |
| 4,612,984 | 9/1986 | Crawford | 166/77 |
| 4,625,799 | 12/1986 | McCormick et al. | 166/223 |
| 4,646,830 | 3/1987 | Templeton | 166/178 |
| 4,658,917 | 4/1987 | Ring | 175/297 |
| 4,685,516 | 8/1987 | Smith et al. | 166/65.1 |
| 4,708,208 | 11/1987 | Halbardier | 166/387 |
| 4,715,445 | 12/1987 | Smith, Jr. | 166/337 |
| 4,759,406 | 7/1988 | Smith et al. | 166/65.1 |
| 4,767,145 | 8/1988 | Bullard | 294/86.18 |
| 4,793,417 | 12/1988 | Rumbaugh | 166/312 |
| 4,796,707 | 1/1989 | Halbardier | 166/387 |
| 4,805,699 | 2/1989 | Halbardier | 166/387 |
| 4,844,166 | 7/1989 | Going, III et al. | 166/379 |
| 4,862,958 | 9/1989 | Pringle | 166/72 |

FOREIGN PATENT DOCUMENTS

| | | |
|---|---|---|
| 2089400 | 6/1982 | United Kingdom . |
| 8400577 | 2/1984 | World Int. Prop. O. . |

*Primary Examiner*—Bruce M. Kisliuk

*Attorney, Agent, or Firm*—Warren B. Kice

[57] ABSTRACT

A hydraulic jar for use in a well and a method of operating same in which an outer housing assembly extends around an inner mandrel assembly in a coaxial relation thereto to define two fluid chambers separated by a piston. The housing assembly is movable relative to the mandrel assembly to force the fluid from one of the chambers to the other. The fluid flow rate is varied between a relative low flow rate and a relative high flow rate in response to the relative position of the housing assembly causing corresponding movement at the latter assembly. A high impact load is transferred to a member connected to the jar in response to a movement at the relatively high flow rate. The jar can be used to create a high impact load in both an upward direction and a downward direction.

11 Claims, 7 Drawing Sheets

HYDRAULIC UP-DOWN WELL JAR AND METHOD OF OPERATING SAME

This is a continuation of co-pending application Ser. No. 269,996 filed on Nov. 14, 1988, now abandoned.

BACKGROUND OF THE INVENTION

1. Field of the Invention

This invention relates to a jar for providing high impact loading in a well and a method of operating same, and, more particularly, to such a jar and method in which the loading can be in both an upward and downward direction.

In various downhole operations in wells for producing hydrocarbon fluids, high impact loading is often necessary to retrieve or set tools for servicing the wells. Both mechanical and hydraulic jars have evolved which are lowered into the wellbore in a well tool string including an accelerator and a stem, which together function to produce a high impact load. In the case of an up jar, the load is directed upwardly to retrieve tools, remove obstructions and the like. In the case of a down jar the load is directed downwardly to set tools, plugs, flow control devices, and the like.

The need for efficient jars becomes more acute in wells that deviate from the traditional vertical orientation, since the angular disposition of at least a portion of the well increases the friction in the well and dissipates some of the vertical thrust needed to activate the jars. Further, the advent of coil, or reeled, tubing, which requires a jar that passes fluid used to service the well, places additional design limitations on the up and down jars, especially from a size standpoint.

In view of these structural and functional demands, a separate jar has to be designed and used for the up operation and a separate jar for the down operation, thus adding to the overall cost of the well service tools. The jars disclosed in U.S. Pat. Nos. 2,828,822 and 2,851,110, issued to C.B. Greer on Apr. 1, 1958, and Sep. 9, 1958, respect are exemplary of hydraulic jars that can only operate in an upward direction. Thus an entirely different jar would have to be designed for use in a downward direction.

SUMMARY OF THE INVENTION

It is therefore an object of the present invention to provide a hydraulic jar which is compact in size and efficient in operation.

It is a further object of the present invention to provide a jar of the above type and a method of operating same in which the jar can be used for both upward and downward impact loading.

It is a further object of the present invention to provide a jar and method of the above type which is adapted for use with coil tubing.

It is a further object of the present invention to provide a jar and method of the above type which can be used in deviated wells.

Additional objects and advantages of the present invention will be apparent to those skilled in the art from studying the following detailed description in conjunction with the accompanying drawings in which the preferred embodiment of the invention is shown.

DESCRIPTION OF THE PREFERRED EMBODIMENT

Figure 1A:
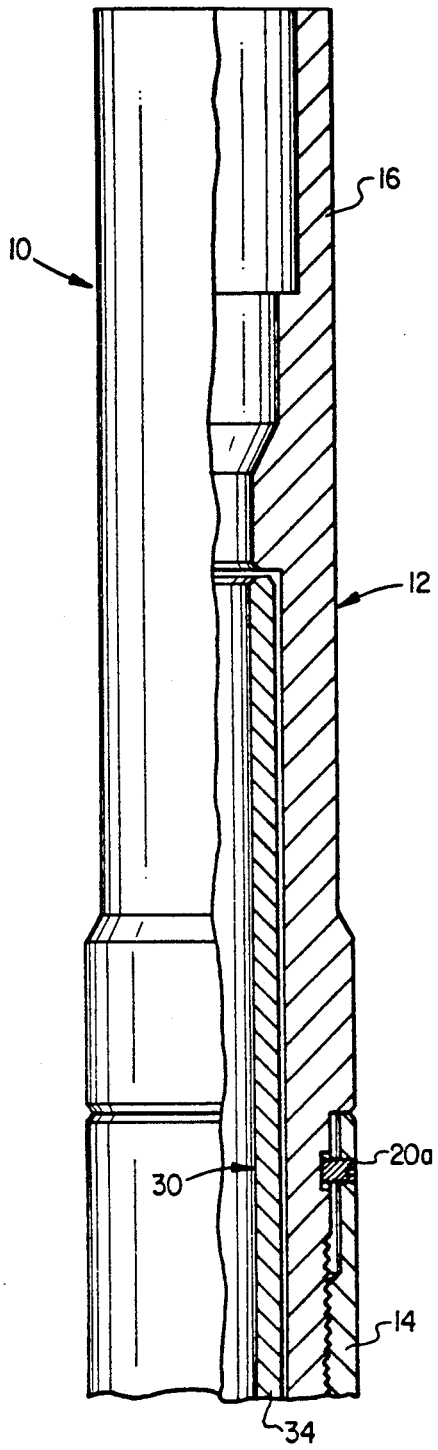
FIGS. 1A, 1B and 1C are longitudinal views, in section and elevation, of the hydraulic jar of the present invention set for use as a down jar in its actuated or retracted position, with FIGS. 1B and 1C being downward continuations of FIG. 1A.
Figure 1B:
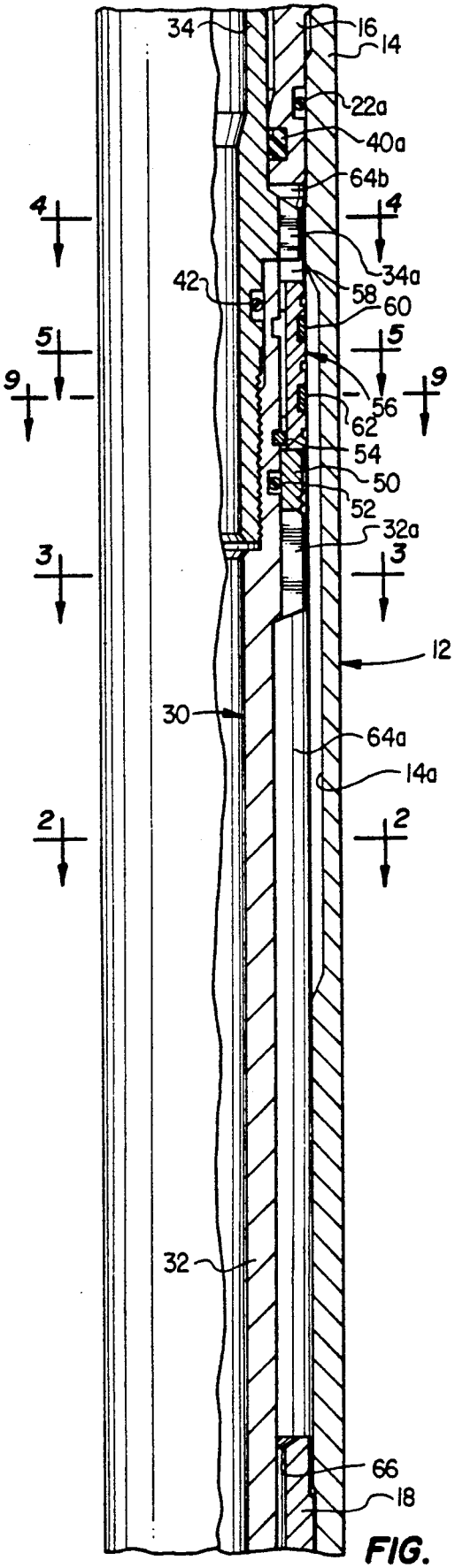
Figure 1C:
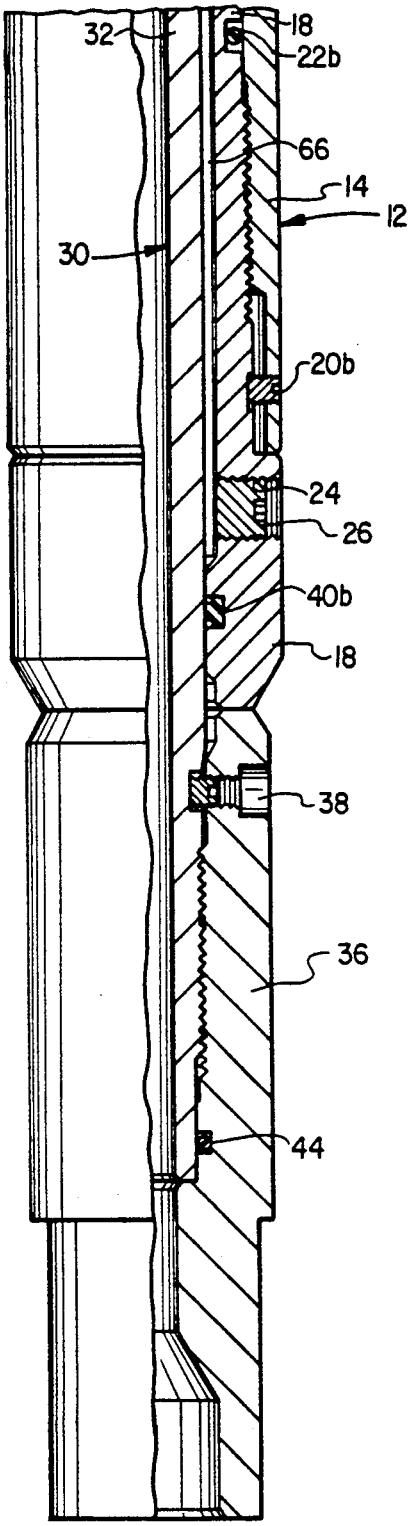

Referring to FIGS. 1A, 1B and 1C of the drawings, the reference numeral 10 refers, in general, to the jar of the present invention adapted to operate as a "down jar", i.e. to provide high impact loading in a downward direction as viewed in the drawings. The jar 10 is shown in its collapsed position after completion of its impact stroke and includes an outer cylindrical housing assembly 12 formed by an intermediate housing member 14 connected between an upper housing member 16 and a lower cap member 18. Internal threading is provided on the two end portions of the intermediate housing member 14 which threadably engage cooperating external threading provided on the upper housing member 16 and the cap member 18, respectively.

The upper end of the upper housing member 16 is adapted for connection to a corresponding end of a section of coil tubing or wireline (not shown). When the jar 10 is placed in the well to be serviced, the coil tubing extends above the surface of the ground and is utilized to push or pull the jar 10 and pass fluid to the jar for passage through the jar for use in servicing the well. The connection between the coil tubing and the upper housing member 16 and the actuation of the coil tubing are well known in the art, and are disclosed in U.S. Pat. No. 4,515,220 and U.S. Pat. No. 4,655,291, issued to Phillip S. Sizer et al. and Don C. Cox, respectively, on May 7, 1985, and Apr. 7, 1987, respectively, and assigned to the same assignee as the present application. In view of this, and due to the fact that these techniques do not form a part of the present invention, they will not be shown nor further described.

A set screw **20*a* extends through aligned threaded radial bores extending through the intermediate housing member 14 and the upper housing member 16, respectively; and a set screw 20*b* extends through aligned threaded bores extending through the intermediate housing member 14 and the cap member 18, respectively, to secure the members against rotational movement. A pair of seal rings 22*a* and 22*b* extend in grooves formed in the upper housing member 16 and the cap member 18, respectively, and engage corresponding inner surfaces of the intermediate housing member 14**.

A fluid inlet 24 is provided through the cap member 18 for the purpose of introducing fluid into the housing assembly 12 for reasons to be described. The inlet 24 is formed by a threaded bore which receives a plug 26 for closing same.

Figure 2:
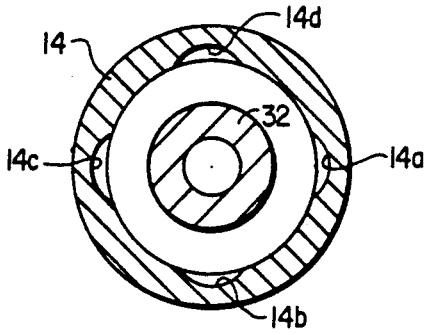
FIGS. 2, 3, 4 and 5 are cross sectional views taken along the lines 2—2, 3—3, 4—4 and 5—5, respectively, of FIG. 1B.

As shown in FIG. 2, four machined grooves 14*a*, 14*b*, 14*c* and 14*d* are formed in the inner wall of the intermediate housing member 14 and are spaced apart at 90 degree intervals, with groove 14*a* also shown in FIG. 1B.

An inner cylindrical mandrel assembly, shown in general by the reference numeral 30, extends within the housing assembly 12 in a coaxial relationship thereto. The assembly 30 consists of an intermediate mandrel member 32 connected between an upper mandrel member 34 and a lower member, or sub, 36. The lower end portion of the upper mandrel member 34 is externally threaded and engages a threaded counterbore formed in the upper end portion of the intermediate mandrel member 32. Internal threading is provided on the upper end portion of the sub 36 which threadedly engages corresponding external threading on the lower end portion of the intermediate mandrel member 32. A set screw 38 extends through aligned threaded radial bores in the sub 36 and in the intermediate mandrel member 32 to secure the members against rotational movement. The lower end portion of the sub 36 is adapted for connection to a well bore tool, or the like, in a conventional manner.

A pair of seal rings 40*a* and 40*b* extend within grooves formed in the upper housing member 16 and the cap member 18, respectively, and engage the outer surfaces of the upper mandrel member 34 and the intermediate mandrel member 32, respectively. The rings 40*a* and 40*b* function to seal against the escape of fluid from the chambers defined by the housing assembly 12 and the mandrel assembly 30, while permitting relative movement between the two assemblies, as will be described. A seal ring 42 extends in a groove formed in the upper mandrel member 34 and engages the inner surface of the intermediate mandrel member 32 to provide a seal between the two members, and a seal ring 44 extends in a groove in the lower sub 36 and engages the corresponding external surface of the intermediate mandrel member 32.

Figure 3:
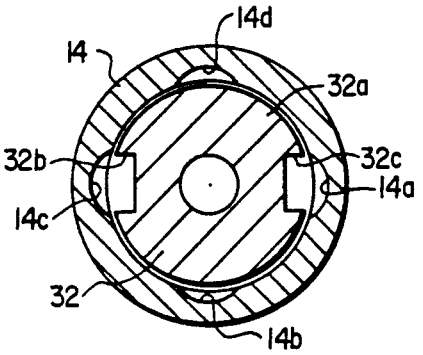
Figure 4:
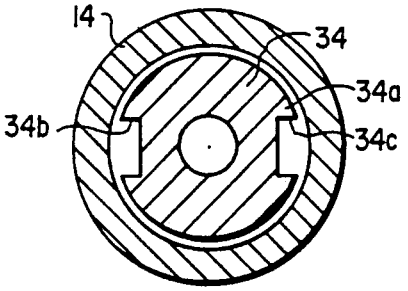

An annular shoulder 32*a* is formed on the outer surface of the intermediate mandrel member 32 near its upper end and, as shown in FIG. 3, has two diametrically opposed grooves 32*b* and 32*c* milled therein. An annular shoulder 34*a* extends from the outer surface of the upper mandrel member 34 near its lower end and, as shown in FIG. 4, has two diametrically opposed grooves 34*b* and 34*c* milled therein. The function of the shoulders 32*a* and 34*a* and their corresponding grooves will be described in detail later.

A seat ring 50 extends around the outer surface of the intermediate mandrel member 32 near its upper end and abuts against the upper end of the shoulder 32*a*. A seal ring 52 is disposed in a groove formed in the upper surface of the intermediate mandrel member 32 and engages the inner wall of the seat ring 50, and a retaining ring 54 is disposed in another groove formed in the upper surface of the intermediate mandrel member 32 and projects slightly from the later groove to retain the seat ring 50 in the abutting position relative to the end of the shoulder 32*a* as shown.

A cylindrical piston 56 extends around the outer surface of the intermediate mandrel member 32 just above the seat ring 50. The inner diameter of the piston 56 is slightly greater than the corresponding outer surface of the intermediate mandrel member 32 to enable the piston 56 to slide in an axial direction in a chamber 58 defined by the members 32 and 14, the upper end of the seat ring 50 and the lower end of the shoulder 34*a*. The diameter of the piston 56 is slightly greater than that of the seat ring 50 and that of the shoulder 34*a* so that the outer annular portions of the respective ends of the piston are exposed for reasons that will be described.

Figure 5:
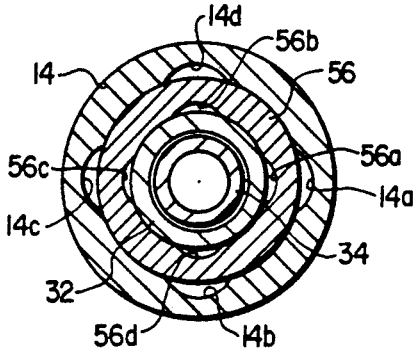
Figure 9:
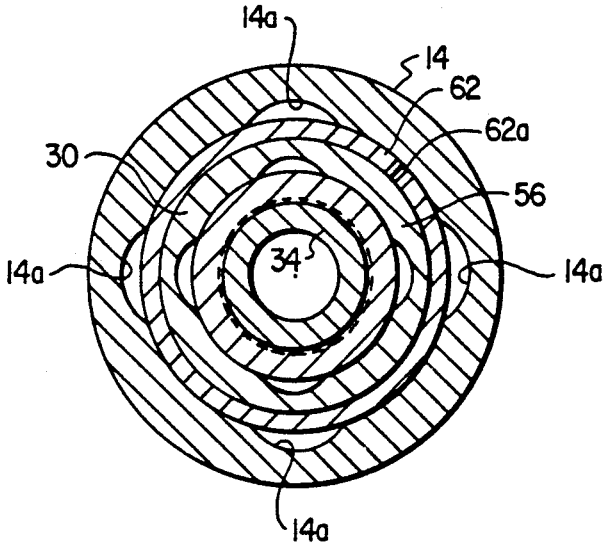
FIG. 9 is a cross-sectional view taken along the line 9—9 of FIG. 1B.

A pair of piston rings 60 and 62 extend in grooves formed in the outer surface of the piston 56 and their outer diameters conform to the inner diameter of the intermediate housing member 14. As shown in FIG. 9, an annular cut, or groove, is formed in the outer surface of each piston ring 60 and 62, as shown by the reference numeral 62*a* in connection with the ring 62, which forms an end gap. The flow of fluid is thus metered through these end gaps and the annular space between the cylindrical piston 56 and the intermediate housing member 14. As shown in FIG. 5, four grooves 56*a*, 56*b*, 56*c* and 56*d* are provided in the inner wall of the piston 56 and are spaced at 90 degree intervals to permit fluid flow therethrough.

In the position of the housing assembly 12 relative to the mandrel assembly 30 as shown in FIG. 1A-1C, the grooves 14*a* (and therefore grooves 14*b*, 14*c* and 14*d* which are not shown in FIGS. 1A, 1B and 1C) extend immediately adjacent the piston 56 in registry with the piston chamber 58.

A fluid chamber is defined by the housing assembly 12 and the mandrel assembly 30 and consists of two sections 64*a* and 64*b*. The chamber section 64*a* communicates with an annular flow passage 66 defined between the inner surface of the cap member 18 and a corresponding outer surface of the intermediate mandrel member 32 which passage receives fluid from the inlet 24. The piston 56, in effect, divides the chamber into the two sections 64*a* and 64*b* extending to the respective ends of the piston and communicating through the piston chamber 58. The fluid thus flows from the inlet 24, through the passage 66 and into the chamber section 64*a* from which it flows into and through the piston chamber 58 and to the chamber section 64*b*. The piston 56 forms a flow restriction to the passage of fluid through the chamber 58 and functions to control the fluid flow between the chamber sections as will be described.

In operation, and assuming the jar 10 is in the wellbore in the collapsed position of FIG. 1A-1C after having being actuated, and assuming that an additional actuation stroke is desired, the housing assembly 12 is cocked by pulling it upwardly, relative to the mandrel assembly 30. This is done by securing the sub 36 and pulling upwardly at a constant force via the coil tubing or wireline, attached to the upper end of the housing member 16. As the housing assembly 12 moves upwardly relative to the mandrel assembly 30, the upper end of the cap member 18 approaches the lower end of the shoulder 32*a* and thus decreases the volume of the chamber 64*a*. This forces the fluid to flow at a relatively high rate from the chamber section 64*a* into the chamber 5 and around the shoulder 32*a*, the seat ring 50, and the piston 56, largely via the added flow paths provided by the grooves 14*a*-14*d*. This flow continues into the chamber section 64*b* via the grooves 14*a*-14*d*, the annular space between the outer surface of the shoulder 34*a* and the inner wall of the intermediate housing member 14, and the grooves 34*b* and 34*c* of the shoulder 34*a*. The fluid is accommodated in the chamber section 64*b* due to the fact that the latter chamber continuously increases in volume with movement of the housing assembly 12 upwardly due to the lower end of the upper housing member 16 moving away from the upper end of the shoulder 34*a*. Since the diameters of the intermediate mandrel member 32 and the upper mandrel member 34 are the same, the sum of the volumes of the chambers 64*a* and 64*b* remain constant through the stroking process.

Figure 6A:
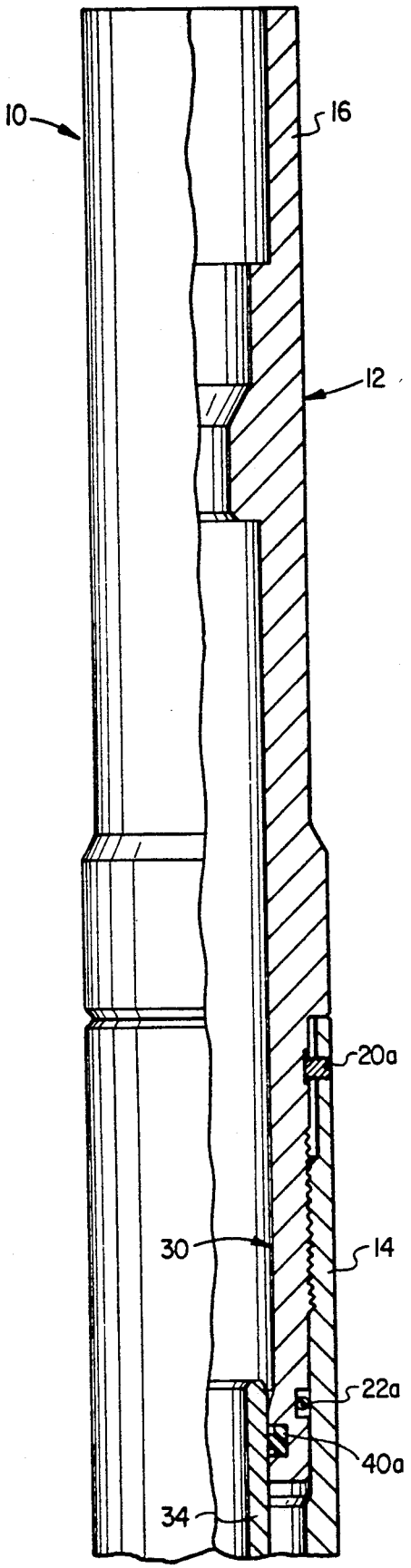
FIGS. 6A, 6B and 6C are views similar to FIGS. 1A, 1B and 1C, respectively, but depicting the jar of FIGS. 1A, 1B and 1C in its cocked or extended position.
Figure 6B:
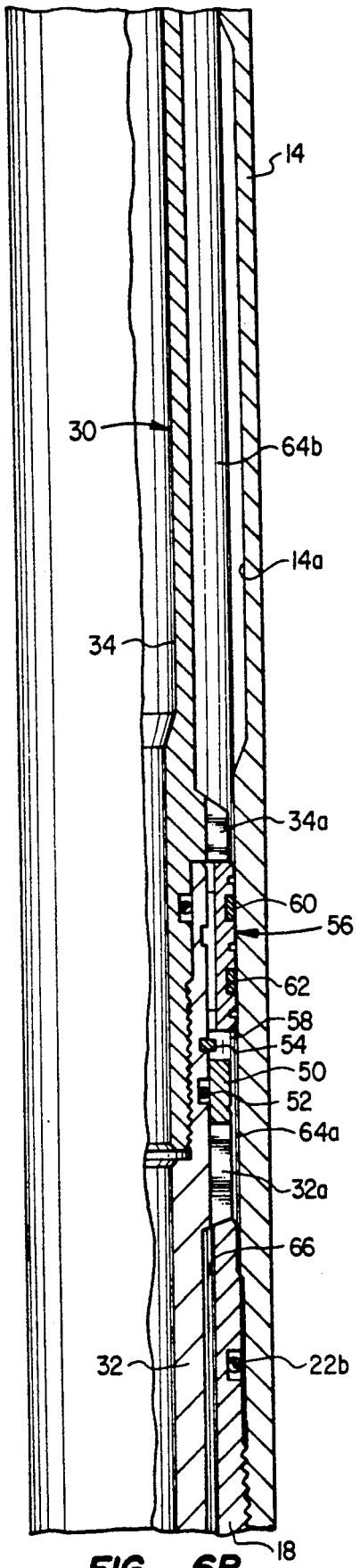
Figure 6C:
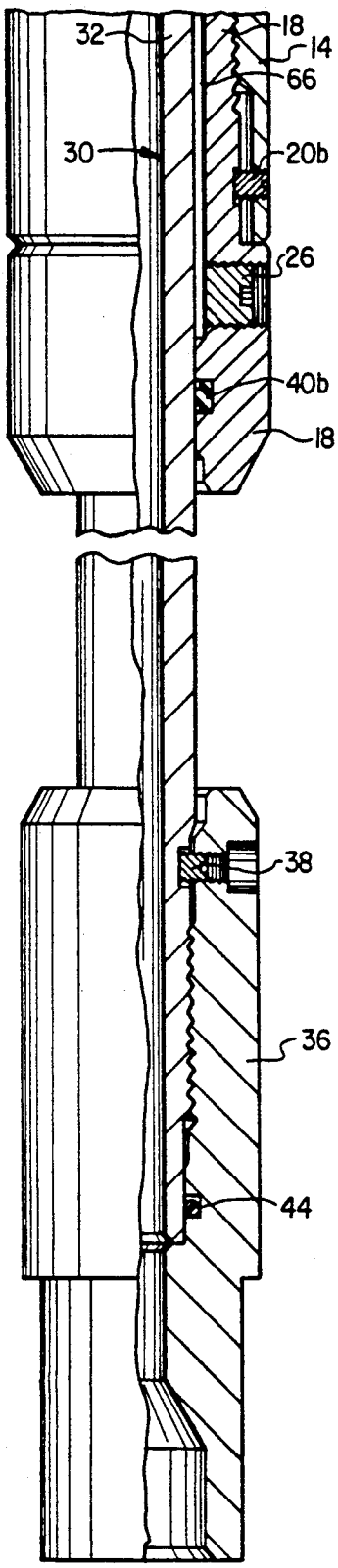

During this flow of fluid from the chamber section 64*a* into the chamber 58 and the chamber section 64*b*, the force of the fluid acting on the exposed outer annular portion of the lower end of the piston 56 and the frictional forces of the fluid between the non-grooved inner surface of the intermediate housing member 14 and the outer surfaces of the piston rings 60 and 62, forces the piston to slide upwardly until it contacts the lower end of the shoulder 34*a*. However, this does not disrupt the relatively high flow rate described above since, upon release of the piston 56 from its contact with the seat ring 50, the grooves 56*a*–56*d* are exposed thus permitting flow therethrough, which flow continues through these grooves and through the grooves 34*b* and 34*c* of the shoulder 34*a* when the piston contacts the shoulder. This movement and flow continue until the upper end of the cap member 18 contacts the lower end of the shoulder 32*a* and the jar 10 is in its expanded, or cocked, position as shown in FIGS. 6A, 6B and 6C. In this position the great majority of the fluid is in the chamber section 64*b*.

When it is desired to actuate the jar 10 from the cocked position of FIGS. 6A, 6B and 6C and produce the desired high impact loading, a constant downward pushing force is exerted on the housing assembly 12 by the coil tubing or wireline connected to the upper end of the housing member 16. This causes the housing assembly 12 to move downwardly relative to the mandrel assembly 30 and force the fluid from the chamber section 64*b*, which continuously decreases in volume with said movement, through the chamber 58 and into the chamber section 64*a*, which continuously increases in volume. The initial movement is relatively slow since the grooves of 14*a*–14*d* of the intermediate housing member 14 are not in registry with the chamber 58 (but rather are located above the chamber 58). Thus, the piston 56 restricts flow through the chamber 58 to meter the flow at a relatively low rate through the end gaps of the piston rings 60 and 62, and the annular flow passage defined between the piston and the corresponding inner wall surface of the intermediate housing member 14. The fluid, by virtue of being metered at a low rate, creates a frictional resistance to downward movement of the housing assembly 12.

During this movement, the force of the fluid acting on the exposed annular upper end portion of the piston 56, and the frictional forces of the fluid between the inner surface of the intermediate housing member 14 and the outer surface of the piston rings 60 and 62, forces the piston away from contact with the shoulder 34*a* and causes downward slideable movement of the piston toward the seat ring 50. During this brief time, additional flow is provided through the grooves 56*a*–56*d* of the piston until the lower end of the piston abuts against the upper end of the seat ring 50 but this additional flow is inconsequential due to the very brief time involved. When the piston 56 reaches the seat ring 50, the latter ring blocks communication between the grooves 56*a*–56*d* of the piston and the grooves 32*b* and 32*c* of the shoulder 32*a*. As a result, the flow from the chamber section 64*b*, through the piston chamber 58 and into the chamber section 64*a* continues at a metered, relatively low rate through the end gaps of the piston rings 60 and 62 and the annular flow passage between the piston 56 and the corresponding inner surface of the intermediate housing member 14.

With the chamber section 64*a* gradually increasing in volume and the chamber section 64*b* gradually decreasing in volume, this relative slow movement continues until the grooves 14*a*–14*d* of the intermediate housing member 14 align with the piston 56. At this position, the area of the flow passage dramatically increases, thus eliminating the frictional resistance of the fluid and causing a downward movement of the housing assembly 12 relative to the mandrel assembly 30 at a relatively high rate. This continues until the lower end of the cap member 18 strikes the upper end of the sub 36 causing a high impact. The resulting force is transmitted by the sub 36 to the tool, plug, or the like to which the lower end of the sub is attached causing the desired high impact loading. This completes the full cycle of operation which can be repeated if desired.

FIGS. 7A–7C, 8A and 8B depict the down jar 10 of FIGS. 1A–1C, 2–5, and 6A–6C, converted to an up jar, i.e., to provide high impact loading in an upwardly direction. More particularly, the seat ring 50 is moved upwardly to a position where its upper end abuts the lower end of the shoulder 34*a* of the upper mandrel member 34. It is noted that in FIG. 7B the seat ring 50 is provided with a groove in its inner wall which receives the seal ring 52 while in FIG. 1B the seal ring 52 is provided in a groove formed in the outer surface of the intermediate mandrel member 32. Although this latter arrangement is preferred from an assembly standpoint to prevent damage to the ring 52 during assembly, it is understood that either arrangement is within the scope of the invention.

Figure 7A:
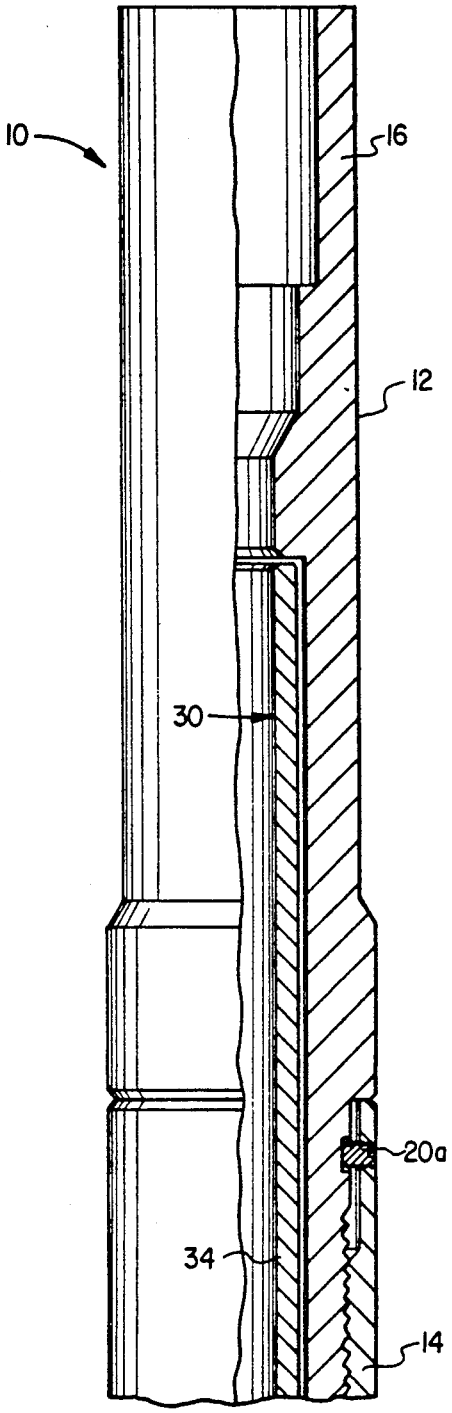
FIGS. 7A, 7B and 7C are views similar to FIGS. 1A, 1B and 1C but depicting the jar cf FIGS. 1A, 1B and 1C set for use as an up jar in its cocked or retracted position.
Figure 7B:
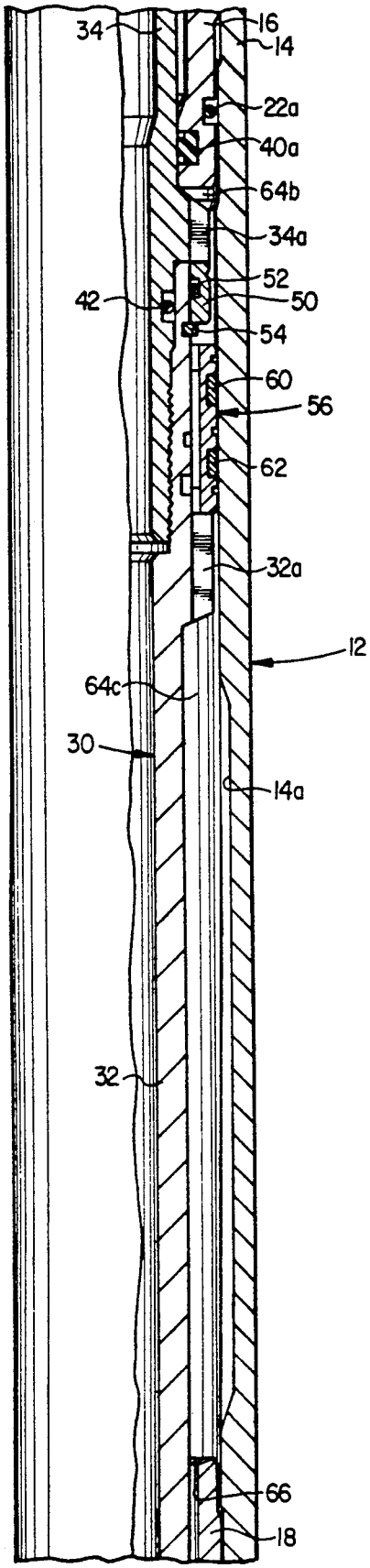
Figure 7C:
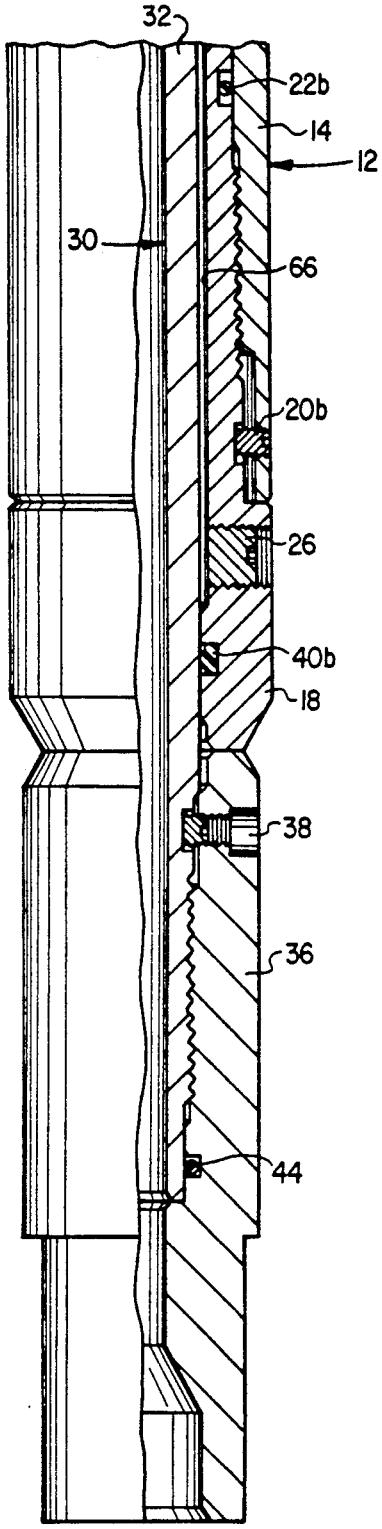

Also in the arrangement of FIGS. 7A–7C, 8A and 8B, the intermediate housing member 14 has been rotated 180 degrees about a horizontal axis as viewed in the drawings so that the location of its ends are reversed. Thus the grooves 14*a*–14*d* are located below the piston chamber 58 when the lower end of the cap member 18 is in abutment with the upper end of the sub 36 as shown in FIG. 7C. In the latter position, the jar 10 is depicted in its collapsed position which corresponds to the collapsed position of the jar in FIG. 1A–1C, but in the case of FIG. 7A–7C this position is its cocked position.

When it is desired to actuate the jar 10 from its cocked position of FIG. 7A–7C, a constant upward pulling force is exerted on the housing assembly 12 by the coil tubing or wireline connected to the upper end of the housing member 16. This causes the housing assembly 12 to move upwardly relative to the mandrel assembly 30 which is held in place by the weight of the tool, or the like, to which it is attached. This forces the fluid from the chamber section movement, through the chamber 58 and into the chamber section 64*b*, which continuously increases in volume. This initial movement is relatively slow since the grooves 14*a*–14*d* of the intermediate housing member 14 extend below the chamber 58, resulting in a metered flow at a relatively low rate through the flow passage defined between the end gaps of the piston rings 60 and 62 and the annular flow passage between the piston 56 and the inner wall of the intermediate housing member 14. The fluid thus creates a frictional resistance to movement of the housing assembly 12.

During this movement, the force of the fluid acting on the exposed annular upper end of the piston 56 and the frictional forces of the fluid between the inner wall surface of the intermediate housing member and the piston rings 60 and 62 forces the piston away from contact with the shoulder 32*a* and causes upward slideable movement of the piston toward the seat ring 50. Thus, additional flow is provided through the grooves 56*a*–56*d* of the piston until the upper end of the piston abuts against the lower end of the seat ring 50, but this additional flow is inconsequential due to the very brief time involved. When the piston 56 reaches the seat ring 50, the latter ring blocks communication between the grooves 56*a*–56*d* and the grooves 34*b* and 34*c* of the shoulder 34*a*. As a result, the flow from the chamber section 64*a* through the piston chamber 58 and into the chamber section 64*b* continues at a metered, relatively low, rate resulting in relative slow movement of the housing assembly 12.

This relative slow movement continues until the grooves 14*a*–14*d* of the intermediate housing member 14 align with the piston 56 at which time the area of the flow passage dramatically increases. The frictional resistance of the fluid is thus eliminated causing a high velocity upward movement of the housing assembly 12 relative to the mandrel assembly 30 which is aided by the tensile forces stored in the coil tubing or wireline.

Figure 8A:
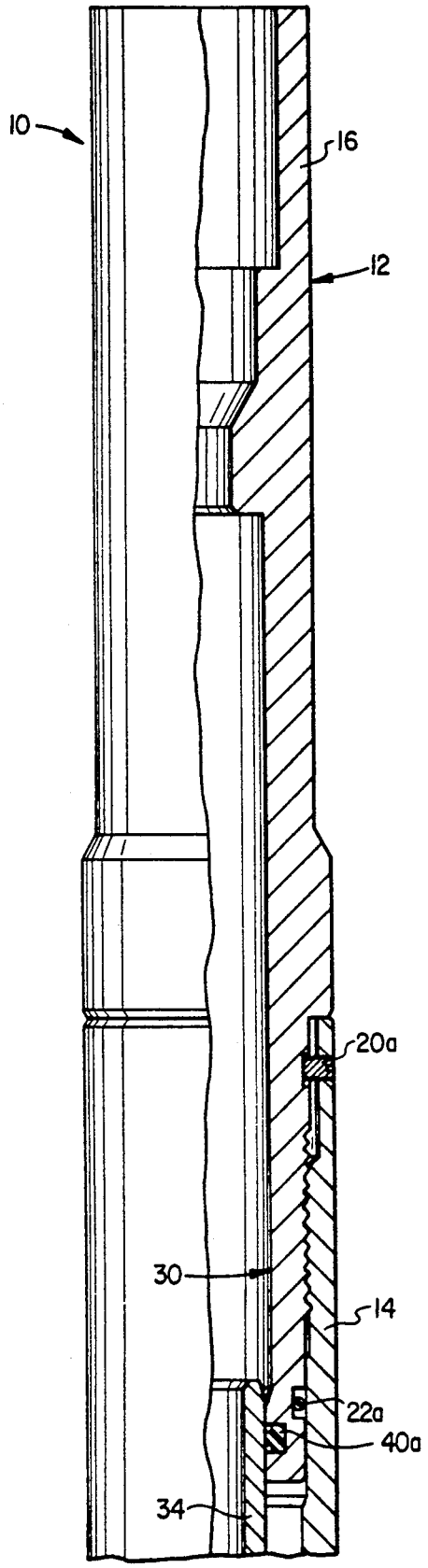
FIGS. 8A and 8B are views similar to FIGS, 7A and and 7B, respectively, but showing the jar of FIGS. 7A, 7B and 7C in its actuated or extended position.
Figure 8B:
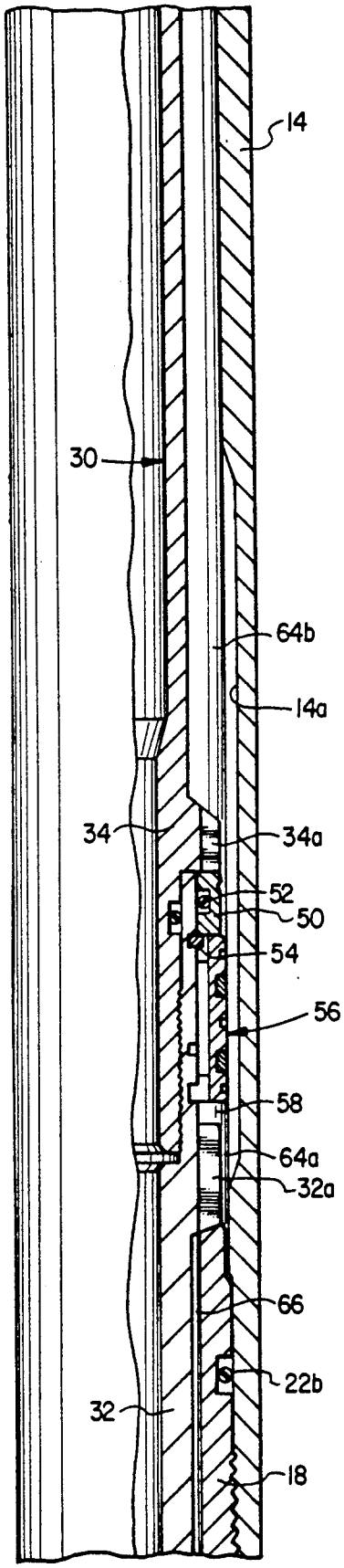

This relatively high-velocity movement continues until the upper end of the cap member 18 strikes the lower end of the shoulder 32*a* as shown in FIG. 8A and 8B causing a relative high impact. The resultant force is transmitted by the sub 36 to the tool, or the like, to which the lower end of the sub is attached causing the desired high impact loading and resultant dislodging of the tool.

The jar 10 can be recocked by pushing the housing assembly downwardly 12 relative to the mandrel assembly 30, which movement is at a relatively high velocity due to the alignment of the grooves 14*a*–14*d* with the piston 56 as described in connection with the upward movement of the housing assembly described in connection with FIG. 1A–1C. As previously described, once the piston 56 traverses the by-pass grooves 14*a*–14*d*, fluid can flow through the piston grooves 56*a*–56*d* and the slots 32*b* and 32*c* until the housing assembly reaches the cocked position of FIG. 7A–7C, and the above operation can be repeated as desired.

It is understood that in both the downloading and uploading operations described above, an accelerator and stem can be used in conjunction with the jar of the present invention to further increase the impact loading.

The previous description is illustrative of only some of the embodiments of the invention. Those skilled in the art will readily see other variations of the hydraulic jar of the present invention. Changes and modifications may be made without departing from the scope of the invention which is defined by the following claims.

What is claimed is:

1. A hydraulic jar connected in a string of components for use in a wellbore, said jar comprising:

a. an inner mandrel assembly;

b. an outer housing assembly extending around said inner mandrel assembly in a coaxial relation thereto;

c. means respectively connecting said mandrel assembly and said housing assembly to two of said components;

d. a fluid chamber defined between said mandrel assembly and said housing assembly;

e. means for forming a restricted flow passage in said fluid chamber for dividing said chamber into two sections in fluid flow communication with said passage;

f. one of said assemblies being movable relative to the other from a cocked position to a jarring position to vary the volume of each chamber section and force the fluid to flow from one of said chamber sections, through said flow passage and to the other chamber section;

g. means responsive to said one assembly moving relative to the other assembly a predetermined distance from said cocked position for increasing the size of said flow passage and therefore the rate of said fluid flow and the rate of movement of said one assembly towards said jarring position; and h. means for providing a high impact load to one of said components in response to said one assembly reaching said jarring position;

i. said means for increasing the size of said flow passage being adjustable between a first position and a second position without changing said connection between said assemblies and said components to permit said impact loading in opposite directions, respectively.

2. The hydraulic jar of claim 1 wherein said means for increasing the size of said passage comprises at least one groove formed in either said housing assembly or said mandrel assembly which, in said predetermined position of said one assembly, aligns with said flow passage to increase the size of said flow passage.

3. The hydraulic jar of claim 2 wherein said groove is positioned out of alignment with said flow passage in said cocked position of said one assembly and during initial movement of said one assembly for said predetermined distance, said groove align with said flow passage after said one assembly has moved said predetermined distance to increase the size of said flow passage.

4. The hydraulic jar of claim 3 wherein, prior to said impact loading, said one assembly is movable from said jarring position to said cocked position to cock said jar.

5. The hydraulic jar of claim 4 wherein, during said movement from said jarring position to said cocked position, said means for forming said restricted flow passage permits said increased fluid flow when said grooves are not in alignment with said flow passage.

6. The hydraulic jar of claim 5 wherein said means for forming said restricted flow passage comprises a piston having grooves formed therein and slidably mounted on said mandrel assembly in said fluid chamber between a first position in which said grooves are exposed to permit said increased flow rate and a second position in which said grooves are blocked to prevent said increased flow rate.

7. The hydraulic jar of claim 2 wherein said housing assembly moves relative to said mandral assembly and wherein said grooves are formed in said housing assembly.

8. A method for operating a hydraulic jar connected in a string of components in a wellbore, said method comprising the steps of:

a. connecting a mandrel assembly and a housing assembly to two of said components, respectively;

b. forming a fluid chamber between said mandrel assembly and said housing assembly;

c. forming a restricted flow passage in said chamber to divide said chamber into two sections in fluid flow communication;

d. moving one of said assemblies relative to the other in one direction from a cocked position to a jarring position to vary the volume of each chamber section and force the fluid to flow through said flow passage from one of said chamber sections to the other;

e. increasing the size of said flow passage during said step of moving to increase the rate of said fluid flow and the rate of movement of said one assembly;

f. providing a high impact load to one of said components connected to said jar in response to said one assembly reaching said jarring position; and g. adjusting the axial position of said groove without changing said connection between said assemblies and said components to permit said impact loading by movement of said one assembly in a direction opposite said one direction.

9. The method of claim 8 wherein a groove is formed in one of said assemblies and is positioned out of alignment with said flow passage during initial movement of said one assembly in both of said directions, and is positioned in alignment with said flow passage after a predetermined amount of said movement of said one assembly from said cocked position to increase the size of said flow passage.

10. The method of claim 9 further comprising the steps of moving said one assembly in opposite directions to both of said directions, respectively to move said one assembly from said jarring position to said cocked position.

11. The method of claim 10 further comprising the step of increasing the size of said flow passage during said movement in said opposite directions to cock said jar.

* * * * *